US012359337B2

(12) United States Patent
Steegh et al.

(10) Patent No.: US 12,359,337 B2
(45) Date of Patent: Jul. 15, 2025

(54) METHOD FOR PASSIVATING A TINPLATE STRIP AND APPARATUS FOR PRODUCING SAID PASSIVATED TINPLATE STRIP

(71) Applicant: TATA STEEL IJMUIDEN B.V., Velsen-Noord (NL)

(72) Inventors: Michiel Steegh, Driehuis (NL); Jan Paul Penning, 's-Gravenhage (NL); Mark Willem Litz, Aerdenhout (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 327 days.

(21) Appl. No.: 17/904,531

(22) PCT Filed: Mar. 15, 2021

(86) PCT No.: PCT/EP2021/056440
§ 371 (c)(1),
(2) Date: Aug. 18, 2022

(87) PCT Pub. No.: WO2021/180980
PCT Pub. Date: Sep. 16, 2021

(65) Prior Publication Data

US 2023/0220579 A1 Jul. 13, 2023

(30) Foreign Application Priority Data

| | | |
|---|---|---|
| Mar. 13, 2020 | (EP) | 20163185 |
| Mar. 19, 2020 | (EP) | 20164228 |
| Apr. 4, 2020 | (EP) | 20168114 |

(51) Int. Cl.
*C25D 11/34* (2006.01)
*C25D 5/50* (2006.01)
(Continued)

(52) U.S. Cl.
CPC ..... *C25D 11/34* (2013.01); *C25D 5/505* (2013.01); *C25D 7/0614* (2013.01); *C25D 11/005* (2013.01)

(58) Field of Classification Search
CPC ..... C25D 11/34
See application file for complete search history.

(56) References Cited

U.S. PATENT DOCUMENTS

| | | | |
|---|---|---|---|
| 2,215,165 A | 9/1940 | Gordon | |
| 2,606,866 A | 8/1952 | Neish | |

(Continued)

FOREIGN PATENT DOCUMENTS

| | | | |
|---|---|---|---|
| EP | 2802688 A | 11/2014 | |
| GB | 2020695 A | 11/1979 | |
| WO | WO-2014006031 A1 * | 1/2014 | ..... C23C 22/76 |

OTHER PUBLICATIONS

English translation WO 2019137782 (Year: 2019).*

(Continued)

*Primary Examiner* — Stefanie S Wittenberg
(74) *Attorney, Agent, or Firm* — Vorys, Sater, Seymour and Pease LLP; Anthony P. Venturino; Maryellen Feehery Hank

(57) ABSTRACT

A method for passivating a tinplate strip after electrodepositing the tin layer or tin layers, or after an optional flow-melting of the electrodeposited tin layer or tin layers, and an apparatus for producing the passivated tinplate strip.

20 Claims, 5 Drawing Sheets

(51) Int. Cl.
*C25D 7/06* (2006.01)
*C25D 11/00* (2006.01)

(56) References Cited

U.S. PATENT DOCUMENTS

| | | | | |
|---|---|---|---|---|
| 3,582,479 | A * | 6/1971 | Schmidt et al. | C25D 5/18 205/147 |
| 10,011,915 | B2 | 7/2018 | Sundermeier et al. | |
| 2015/0010773 | A1 | 1/2015 | Sauer et al. | |
| 2015/0072167 | A1 | 3/2015 | Stein-Fechner et al. | |

OTHER PUBLICATIONS

International Preliminary Report on Patentability and International Search Report for corresponding PCT Application No. PCT/EP2021/056440 filed Mar. 15, 2021.

* cited by examiner

METHOD FOR PASSIVATING A TINPLATE STRIP AND APPARATUS FOR PRODUCING SAID PASSIVATED TINPLATE STRIP

FIELD OF THE INVENTION

This invention relates to a method for passivating a tinplate strip after electrodepositing the tin layer or tin layers, or after an optional flow-melting of the electrodeposited tin layer or tin layers, and an apparatus for producing said passivated tinplate strip.

BACKGROUND OF THE INVENTION

Tinplate is light gauge, cold-rolled low-carbon steel sheet or strip, coated on both faces with commercially pure tin to protect the steel sheet from corrosion, which is used mainly in the packaging industry. The tin layer is usually deposited electrolytically, usually in a continuous production line.

Tinplate combines in one material the strength and formability of steel and the corrosion resistance, solderability and good appearance of tin. Within this broad description, there exists today an extremely wide range of products, tailor-made to meet end-use requirements. Production of the steel base and its subsequent coating with tin are independent of each other, so that any set of properties in the steel, can in theory be combined with any tin coating. The composition of the steel used for tinplate is closely controlled and according to the grade chosen and its manner of processing, various types with different formabilities ("tempers") can be produced. Tinplate is sold in a range of steel thicknesses, from around 0.10 mm to 0.49 mm. The steel can be coated with differing thicknesses of tin. Even different thicknesses on the two faces (differential coatings) may be produced to cater for varying conditions at the internal and external surfaces of a container. A variety of surface finishes are also produced for diverse applications.

Tin is deposited as a whitish coating having a slight metallic lustre. When required this is flow-melted by induction or resistance heating (or a combination) to produce a bright mirror-like finish. This flow-melting process enhances the corrosion resistance of the product by formation of an inert tin-iron alloy layer. Most DWI tinplate (drawn and wall ironed) is not flow-melted, and this can be a significant part of the output for many manufacturers.

Tinplate, and flow-melted tin plate in particular, has a thin tin oxide film on the surface, which if untreated can grow in thickness on storage. To improve the tarnish resistance and the adhesion to organic coatings a chemical or electrochemical passivation is applied to the strip. For decades the most common form of passivation involved a cathodic treatment at temperatures between 50 and 85° C. in dichromate or chromic acid solution containing dichromate. This treatment deposits a complex layer of chromium and its hydrated oxides, which inhibits the growth of tin oxides, preventing yellowing, improving paint adhesion and minimising staining by sulphur compounds. Dichromate or chromic acid solution contain $Cr^{6+}$ and these solutions are progressively being objected to because they are harmful, especially in the case of metal products that are intended for the food industry. An EU regulation (REACH) has banned the use of these solutions if an alternative is available.

When tinplate is used to make containers (cans) for preserving food stuff, the passivation must prevent too strong a growth of the tin oxide layer during the storage of the tinplate or the food container made therefrom until it is coated with a protective layer and subsequently until the preserved contents are consumed. In addition, the passivation should prevent discolorations of the tinplate surface. Such discolorations arise, for example, when cans that contain sulphur-containing substances are sterilized, since the sulphur reacts with the tin in the coated steel surface if it is not sufficiently passivated. Because of the matte discoloration (marbling) or gold discoloration of the surface of the packaging, the consumer may get the idea that the contents are tainted. Adhesion problems of the protective layer may also arise, and these can be avoided by passivation of the coated steel sheet. The passivation moreover must guarantee the resistance of the metal container, after being filled with food stuff, to the acids contained in the foods. If the passivation of the tinplate is not adequate, then such acid anions in the can contents can give rise to delamination of the inner protective layer of the container, and corrode the underlying tinplate.

EP2802688 discloses a method for passivating the surface of tinplate wherein after the tinning the surface is anodically oxidised in order to form an oxide layer which essentially consists of tetravalent tin oxide, followed by the application of a liquid solution of a chromium-free after-treatment agent. The method in EP2802688 claims that the resistance of the tinplate to corrosion and to the reaction with sulphur can be considerably increased by the anodic oxidation before the post-treatment with a chromium-free post-treatment agent. An oxide layer with a layer thickness in the nm range is produced on the tinned steel strip surface by the anodic oxidation. The oxide layer is substantially a layer of tetravalent tin oxide ($SnO_2$). A thin surface layer of a chromium-free post-treatment agent deposited on this oxide layer is claimed to protect the surface of the tinned steel strip completely and effectively against corrosion and against a reaction with sulphur.

A problem with the prior art method is that 1) the oxidation of the strip is not homogeneous over the width of the strip, leading to differences over the width of the strip in protecting the tinplate surface against corrosion and against a reaction with sulphur, and also to a difference in adhesion between a further protective layer and the tin layer on the steel strip, and 2) that the newly applied oxide layer is formed on top of an already existing, undefined, oxide layer.

OBJECTIVES OF THE INVENTION

It is an objective of this invention to provide a method for passivating a tinplate strip after electrodepositing the tin layer or tin layers that has an improved homogeneity of the oxide layer over the width of the tinplate strip.

It is also an objective of this invention to provide a method for passivating a tinplate strip after electrodepositing the tin layer or tin layers that has an improved homogeneity of adhesion between a further protective layer and the tin layer on the steel strip.

It is also an objective of this invention to provide a method for passivating a tinplate strip after electrodepositing the tin layer or tin layers that has an improved corrosion resistance and marbling resistance over the width of the tinplate strip.

It is also an objective of this invention to provide a method for passivating a tinplate strip after electrodepositing the tin layer or tin layers that is an alternative for the use of dichromate or chromic acid solutions.

DESCRIPTION OF THE INVENTION

The objective of the invention is reached by the method according to claim 1. Preferred embodiments are provided by the dependent method claims 2 to 13.

The method in accordance with the invention will now be further explained by means of a particular and non-limiting embodiment. Any ranges mentioned herein below have general applicability for the method according to the invention and are not limited to the embodiment below, and are also independently applicable.

In the first step of the embodiment in accordance with the invention, electrolytic deposition of a tin layer on a cold-rolled steel strip (blackplate) is performed in a continuous electrolytic tinning line operating at a speed of at least 50 m/min. After coating with a tin layer on one or both sides the blackplate becomes tinplate. Current high speed industrial electrolytic tinning lines can operate up to a speed of about 750 m/min. After depositing the tin layer the tinplate is heated to a temperature above the melting point of tin (232° C.) in order to melt the tin layer. As a result of the melting the tin forms an iron-tin $FeSn_2$ intermetallic compound with the iron from the steel strip. The surface of the tin layer remains tin and becomes very shiny after solidification by quenching in water. A new oxide layer forms immediately on the fresh surface, and this oxide layer keeps growing during storage, and is defined as the pre-existing oxide layer in the context of this invention. Although the re-melting of tin as described is an optional feature, most tinplate is subjected to such a re-melting or flow-melting step.

In the second step of the method in accordance with the invention the pre-existing oxide layer on the tin is fully cathodically removed in an electrochemical treatment tank containing a basic aqueous solution serving as the electrolyte, which in this example is a sodium carbonate solution. The tinplate enters the electrochemical treatment tank in a downwardly direction (i.e. the entry-pass is a down-pass) by means of a non-conductive guide roller. Near the bottom in the vertical tank is a non-conductive sink-roll over which the tinplate strip reverses travel. A potential is applied between the tinplate and the counter electrodes (for example stainless steel anodes) in the tank. The tinplate strip is moved along at the strip speed and is connected as the cathode in the sodium carbonate solution. After the removal of the oxide the tin-layer no longer has an oxide layer on its surface, i.e. the tinplate surface is a pure (bare) tin surface, over the entire width of the tinplate for reasons explained herein below.

After reversing the travel direction of the tinplate by means of the sink-roll the tinplate starts the exit-pass in the upwardly direction (i.e. the exit-pass is an up-pass). During the exit-pass the tinplate is connected as the anode in the same basic aqueous solution. A potential is applied between the tinned steel strip with the bare surface and the counter electrodes (for example stainless steel cathodes). As a result a new oxide layer is grown onto the steel strip under carefully controlled conditions on the pure (bare) tin surface resulting from the cathodic removal of the pre-existing tin oxide. The charge Q1 needed to remove the pre-existing oxide is considerably lower than the charge Q2 needed to grow the new oxide layer to the required thickness for the oxide layer to provide enough corrosion resistance and marbling resistance. The re-oxidised tinplate leaves the electrochemical treatment tank by means of a non-conductive guide roller.

In the process according to the invention it is essential that the guiding means for guiding the strip into, in and out of the electrochemical treatment tank such as guide rollers and sink roll, are electrically non-conductive, because no current may flow from the strip through the guiding means to the earth. For a guide roller or sink roll to be electrically non-conductive the rollers, who are usually made from metal, are covered with a rubber layer.

In the process according to the invention the imposed charge during the entry-pass is the same as during the exit-pass. This means that the value of Q1 is larger than required to remove the pre-existing oxide layer, and that the tinplate always has a pure and bare tin surface when the anodic re-oxidation starts. In this embodiment only one rectifier is needed if the anodes and cathodes are operated in pairs, or two if the top (right) and bottom (left) cathode/anodes are operated separately. In most cases a single rectifier will suffice. This makes the process both simple to control, because Q2 is leading, and also technically simpler because in all practical cases Q2 is significantly larger than Q1. In the embodiment according to the invention it is not necessary to check whether the pre-existing oxide is fully removed.

The anodization time corresponds to the residence time of the tinned steel strip in the electrochemical oxidation bath during the exit pass. This is determined by the anode length and the strip speed. For typical low strip speeds of about 50 m/min it lies in the range of about 2 to 2.5 seconds. For high strip speeds of about 750 m/min the anodization time is about 0.1 s to 0.2 seconds. For most industrial lines the anodization time therefore lies between 0.1 s and 2.5 s, preferably in the range of 0.15 s to 1.5 s, more preferably at most 1.0 seconds, even more preferably at most 0.7 seconds, and still more preferably at most 0.4 s.

The spacing between the tinplate strip and the counter electrodes in the electrolyte bath is set in dependence on the system. It lies, for example, in the range of 3 to 15 cm, preferably in the range of 5 to 10 cm, and especially around 5 cm.

The temperature of the electrochemical oxidation bath preferably lies in the range of 25 to 60° C., more preferably in the range of 25 to 50° C., and especially around 35° C.

In the third step of the method the anodically re-oxidised tinplate strip is rinsed with, for example water or de-ionised or demineralised water, and subsequently dried, for example, with hot air. However, other drying means are also suitable, such as drying with water-absorbing solvents followed by drying with a cold or hot air blower, hot air being preferred, drying with convection air-free drying systems like IR radiators, inductive heating, or resistance heating, or drying only with a cold or hot air blower, preferably a hot air blower.

In the fourth step of the method, a coating of the anodically re-oxidised tinplate strip with a post-treatment agent takes place. Although this step is optional, and the product produced up to and including the third step already can be considered a passivated tinplate, the use of this additional fourth step is preferable for longer term and consistent passivation. A solution of the post-treatment agent, preferably a solution in water or an organic solvent or a ready to use preparation of the post-treatment agent, is sprayed onto the steel strip, which is moving at the strip speed. 1.5 to 10% aqueous solutions of the post-treatment agent proved to be expedient. Preferably the thickness of the solution of the post-treatment agent is then homogenised by homogenisation rollers and dried. A thin film of the post-treatment agent remains on the surface of the coated metal strip after the drying, where the weight of said thin film as a rule is between 2 and 30 $mg/m^2$. Suitable application techniques for the post-treatment agent include: dipping, dipping with squeegee rolls, rotor-spray application, rotor-spray application supported by the use of a smoothing roll, spray application, spray bar(s), spray-squeegee application, application by means of a roll coater systems, application by slot coating, slot curtain coating, etc. If so desired any excess treatment agent may be stripped of by squeeze roller pairs arranged after the application of the post-treatment agent in the direction of strip travel, and in some case the excess post-treatment agent can be re-used.

Suitable post-treatment agents that can be used in combination with this invention are:

- all organic systems such as organic acids (oleic acid, abietic acid);
- all organic systems such as acrylates, polyurethane dispersions and other types of thin organic coatings;
- organic/inorganic coupling agents, such as one-component and two-component siloxane systems;
- inorganic systems such as silicate-based systems;
- inorganic systems in an organic matrix such as fluoro-titanates and zirconium-titanates in combination with an organic polymer matrix.

It is preferable to use inorganic systems in an organic matrix such as fluoro-titanates and zirconium-titanates in combination with an organic polymer matrix. Such post-treatment agents are commercially available nowadays such as indicated below.

After re-oxidation and rinsing and drying the post-treatment agent is applied to the anodically re-oxidized tinplate surface by application techniques that are common for such passivation systems. The post-treatment agent preferably is a chromium-free, preferably no-rinse/dry-in-place post-treatment agent. This post-treatment agent may be based on zirconium, titanium, a combination of zirconium and titanium, phosphates, siloxanes, etc., such as an acidic aqueous composition containing water-soluble inorganic compounds of the elements Zr, Ti, Hf and/or Si as disclosed in U.S. Ser. No. 10/011,915. Examples are, Gardobond® X4744, Oxsilan® MM0705 (by Chemetall) or Primecoat® Z801 (by AD Chemicals), Bonderite® M-NT1455, Bonderite M-NT1456, Bonderite M-NT10456 (by Henkel). This is prepared as a solution with a dry coverage in the range of 0.2 to 2 mg Ti/m$^2$, more preferably 0.5 to 1.5 mg Ti/m$^2$ or 0.8 to 1.5 Ti/m$^2$, in particular by 1 mg Ti/m$^2$, on the tinned and re-oxidized steel strip surface.

Advantages of a no-rinse/dry-in-place post-treatment agent over an electrolytic system is that the solutions are simple to apply, use simple equipment in compact application units, allowing easy fitting on existing lines and more versatile chemistries are available. The post-treatment agent can be applied to the surface treated tinplate surface by application techniques that are common for such passivation systems. Suitable application techniques include: dipping, dipping with squeegee rolls, rotor-spray application, rotor-spray application supported by the use of a smoothing roll, spray application, spray bar(s), spray-squeegee application, application by means of a roll coater systems, application by slot coating, slot curtain coating, etc.

The inventors also found that, although it is preferable to perform the cathodic removal of the pre-existing oxide, the anodic re-oxidation and the subsequent passivation step with the post-treatment agent immediately and without interruption after tinplating and the optional flow-melting in a continuous process, the method is also able to process tinplate that has not been cathodically and anodically treated passivated immediately after tinplating and the optional flow-melting. The method according to the invention can also be used to process coils of tinplate that have been produced earlier. This situation occurs for instance when there is a delay between production of the tinplate strip and the passivation, for instance after a period of storage of the tinplate strip, usually in coiled form, for whatever reason. Any growth of the oxide layer that occurs in the meantime can be easily dealt with by the cathodic removal of the pre-existing oxide and starts the subsequent process which results in just as pure and bare a tin layer as when the process would have been performed continuously and immediately after tinplating. The method according to the invention is able to deal with additional spontaneously grown of oxide because Q2 is significantly larger than required to remove the pre-existing oxide, and the excess charge is used to remove any additional spontaneously grown oxide.

During the cathodic removal of the pre-existing tin-oxide hydrogen is being developed at the cathodic strip once the pre-existing oxide has been cathodically removed. Particularly if Q1 is much smaller than Q2 mode it may be beneficial to capture the hydrogen by hydrogen capturing means, for safety reasons and for environmental reasons. Q1 is usually much smaller than Q2 in cases where the tinplate after tinning is processed either in-line (i.e. immediately) or with a very short time and with controlled storage in between the tinning and the passivation treatment.

The sole purpose of the basic aqueous solution is to enable the cathodic and anodic treatment, not to deposit foreign species contained in the electrolyte onto the substrate surface. The pH of the basic aqueous solution may not be too low, not lower than pH=8.75 otherwise the efficiency of the electrochemical reaction becomes too low and then the process cannot be incorporated into existing high productivity process lines. Also, the pH of the basic aqueous solution is not higher than 11.0 and preferably not higher than 10.5 because that will increasingly cause the dissolution of the tin layer in the basic aqueous solution.

In the context of the invention the thickness of the tin oxide layer (D) is expressed in Coulomb/m$^2$ and represents the total charge needed to reduce the layer to metallic tin. The thickness of the tin oxide layer is related to the anodic treatment time (t) and current density (A) by $D=E\times A\times t$, where E is the efficiency of the electrochemical reaction, and wherein D is at least 15 C/m$^2$.

The efficiency thus represents the ratio of the thickness D of the produced oxide layer to the applied charge density ($A\times t$), and can be estimated by plotting D as a function of ($A\times t$). Initially, at values of anodic charge passed below 50 C/m$^2$ the curve is more or less linear, but with increasing anodic charge passed, the efficiency E decreases leading to a slower growth rate of the tin oxide layer, and thus in a slower increase in D. If D<15 C/m$^2$, then the tin oxide layer is too thin and is not effective in achieving the desired sulphide staining resistance. A minimum thickness of D of 15 C/m2 is therefore required.

The total D as specified above can be achieved by any combination of A and t, but a combination of a high current density (A>0.1 A/dm$^2$, preferably A>1.0 A/dm$^2$) in combination with a short treatment time (t<1 s) is preferred in view of its processability on a high-speed tinning line. The interchangeability of A and tin the anodic re-oxidation treatment implies that the process can be operated at short treatment times by adjusting the applied current density accordingly. Thus, the method according to the invention can be employed in industrial tinning lines running at line speeds in excess of 300 m/min to speeds of up to 1000 m/min. Furthermore, the treatment time t is determined not only by line speed v but also by the effective length or 'anode length' L of the treatment section, according to t=L/v, meaning that the processing window can be further extended by the proper choice of the anode length L. For instance, to deposit a layer having a thickness of 50 $C/m^2$ (assuming E=1) on a line running at 600 m/min (10 m/s) a current density A of 1000 $A/m^2$ and a treatment length of 0.5 m would be required. It could also be done at a current density of 100 A/m2 if the treatment length is 5 m. This design and process flexibility is a great advantage of this method. The advantage of the method according to the invention is that the cathodic removal always requires less current than the subsequent anodic re-oxidation because of the required thickness of the re-oxidised oxide layer. When the pre-existing tin layer is fully cathodically removed hydrogen is formed at the anode, but the pure and bare tin layer remains untouched. It may be beneficial to capture the hydrogen by hydrogen capturing means, for safety reasons and for environmental reasons.

In an embodiment of the invention the cathodic removal anodic treatment is performed in-line with and immediately after electrolytic tinning and the optional flow-melting step, wherein the anodic re-oxidation after cathodic removal of the pre-existing tin oxide layer treatment time (t) is at most 5 seconds, preferably at most 2 seconds, more preferably between 0.05 seconds and 1.5 seconds. This range and the more preferable ranges are consistent with high speed processing lines. In an embodiment the cathodic and anodic treatment is performed in-line with an industrial electrolytic tinning line, and wherein the current density during the anodic treatment (A) is at least 10 $A/m^2$, preferably at least 50 $A/m^2$ and more preferably at least 100 $A/m^2$, and/or at most 4000 $A/m^2$, preferably at most 2000 $A/m^2$ or more preferably at most 1000 $A/m^2$. This range and the more preferable ranges are consistent with high speeds processing lines.

The main function of the basic aqueous solution is to support the electrochemical reaction intended by the cathodic and anodic treatment while the ionic species present in the basic aqueous solution do not take part in the electrochemical modification of the tinplate surface. The preferred basic aqueous solution contains cations from Group 1 (e.g. $Na^+$, $K^+$) or Group 2 (e.g. $Mg^{2+}$, $Ca^{2+}$) from the Periodic Table or polyatomic cations (e.g. $NH_4^+$), and polyatomic anions (phosphates, borates, sulphates, carbonates and the like). Also, the anion may be the conjugate base of an organic acid (e.g. acetates, citrates). Since it is of importance that the pH be maintained within certain boundaries, a buffered solution could be used. It is preferable that the basic aqueous solution does not contain mono-atomic halogen anions (Group 17) such as $Cl^-$, $F^-$.

Preferably the aqueous buffered solution contains sodium carbonate, and preferably no borates, phosphates, sulphates or the like. The concentration of sodium carbonate in the aqueous buffered solution is preferably 1 wt % to 10 wt %, particularly 2 wt % to 8 wt %, preferably 3 wt % to 7 wt %, above all 4 wt % to 6 wt %, especially about 5 wt %.

Furthermore the basic aqueous solution may contain other chemical additives, such as surfactants, wetting agents, anti-foaming agents etc. to support the electrochemical treatment, provided these additives do not adversely affect the removal of the pre-existing tin oxide layer and the re-formation of the tin oxide layer.

The anodic treatment of the tin-plated surface converts the extreme outer layer of the tin surface from metallic tin into tin oxide by electrochemical oxidation. The tin oxide layer produced as such (within a certain range of thickness) provides a barrier against sulphide staining. The tin oxide layer is, however, not sufficiently stable and/or passive in itself and will, during prolonged storage under ambient and/or humid conditions, or during heat treatments such as baking and stoving, continue to grow into a thicker tin oxide layer with undesirable properties (poor wettability, yellowish appearance, poor lacquer adhesion). The after-treatment agent on its own will usually provide a stable passivation layer protecting the tinplate against uncontrolled growth of tin oxides and furthermore providing good adhesion of organic coatings. However, the passivation layer in almost all investigated cases has a poor resistance against sulphide staining. By applying the present invention, a favourable combination of properties is achieved. First, a tin oxide layer of the correct thickness and the correct composition, i.e. consisting mainly of SnO (i.e. predominantly consisting of SnO), preferably consisting only of SnO, is applied by employing the cathodic and anodic treatment under proper process conditions, and then the tin oxide layer is passivated and/or stabilised against further uncontrolled growth, by applying a post-treatment agent passivation system on top of it, by using a non-electrolytic application method to produce a post-treated tinplate.

The Cr(VI)-free passivation system before which the anodic treatment is applied must be a chemical passivation treatment, preferably a so-called no-rinse process, for the application of a no-rinse, dry-in-place passivation system.

The inventors found that the thickness of the tin oxide layer on the strip must be between 15 and 100 $C/m^2$. It is preferable for the thickness of the tin oxide layer D to be at most 100 $C/m^2$. A value above 100 is not only economically unattractive in the high-speed tinplating process, it also leads to a reduced adhesion of subsequently applied organic coatings, particularly at the edges of the tinplate because of the increasing presence of $SnO_2$ in the oxide layer. The value of at least 15 $C/m^2$ is considered to be the minimum required to reliably remove the pre-existing oxide even if no further additional spontaneous growth of the oxide layer has occurred. At values below 15 $C/m^2$ remnants of oxide could be found. The inventors found that it is preferable for the thickness of the tin oxide layer on the strip to be at least 25 $C/m^2$. A suitable maximum value for D from a process efficiency and tin-oxide species point of view is 80 $C/m^2$, preferably 70 $C/m^2$ or even 60 $C/m^2$. Good results were obtainable with a thickness on the strip of between 30 and 60 $C/m^2$. A suitable minimum value of D is 35 or even 40 $C/m^2$ provided excellent results.

Assuming the efficiency E=1, then the above values also reflect the settings on the rectifier for the anodic re-oxidation step. However, it should be noted that as a result of spontaneous growth during storage the oxide layer may grow, and thus result in a thicker oxide layer than would be expected on the basis of the rectifier setting. However, assuming that no spontaneous growth occur the value of E is easily determinable by measuring the thickness on the strip with the method described herein and correlating the result with the rectifier setting. That way the setting on the rectifier can be "translated" into an oxide layer thickness on the strip, and the preferred values between 15 and 100 $C/m^2$ are reliably and reproducibly obtainable.

In an embodiment the article is a strip of packaging steel provided with a tin layer on at least one side (for typical chemical compositions see e.g. EN10202-2001 or ASTM 623M). This strip is produced in a known way, e.g. by cold rolling and annealing and optionally temper rolling a steel strip of suitable composition, followed by electrolytic tinplating.

The cathodically and anodically treated tinplate, optionally treated with a post-treatment agent, can be coiled for storage and transport and later uncoiled. The passivated tinplate produced according to the invention can be further provided with an organic coating layer such as epoxy-phenolic gold lacquers, epoxy-anhydride white lacquers, PVC or vinyl organosol coatings, polyester lacquers, epoxy-amino or epoxyacrylic-amino waterborne coatings. The excellent adhesion of organic coating layers to the passivated tinplate enables to provide this product as a replacement for CDC treated and subsequently polymer coated systems, thereby avoiding the use of chromates altogether.

Alternatively the cathodically and anodically treated tinplate, optionally treated with a post-treatment agent, can be transferred to a lamination unit where a laminate layer is laminated in-line onto the tinplate.

The application process of the laminate layer to the tinplate is preferably performed by means of extrusion coating and lamination, wherein a polymer is melted and formed into a thin hot film in a flat (co-)extrusion die, wherein the extruded polymer film is subsequently led onto a cast or cooling roll and then laminated onto the heated tinplate substrate to form the laminated tinplate. The laminated tinplate then usually passes through a roll-nip assembly, which presses the laminate layer firmly onto the substrate to ensure complete contact and adhesion.

The alternative is film lamination, where a solid laminate layer is supplied and coated onto a preheated tinplate and pressed onto the tinplate by a roll-nip assembly to ensure complete contact and adhesion of the laminate layer to the preheated tinplate.

Suitable single layer or multilayer polymers comprise or consists of one or more of polyethylene terephthalate (PET), Isophthalic Acid-modified polyethylene terephthalate (IPA-PET), Cyclohexanedimethanol-modified polyethylene terephthalate (CHDM-PET), polybutylene terephthalate, polyethylene naphthalate, or copolymers or blends thereof, or polycondensates such as polyethylene (PE) or polypropylene (PP).

EXAMPLES

Tinplate was produced in various tempers ranging from TS245 to TS290 and TH415 to TH620. Table 1 shows an overview of tempers and examples of uses. Tin layer thicknesses were varied as well depending on the intended use and ranged from 1.4 to 11.2 on one side and from 1.7 to 5 on the other side. The results of the passivation according to the invention proved to be independent of the temper and of the tin layer thickness. Most of the tinplate was subjected to a flow-melting step.

TABLE 1

An overview of tempers and examples of uses

| Temper classification | | | Yield 0.2% proof Rp | Hardness | |
|---|---|---|---|---|---|
| Current | Future | Former | (±50 N/mm$^2$) | HR30T(=4) | Examples of tires |
| T50BA | TS230 | T1 | 230 | <=52 | Deep drawing |
| T52BA | TS245 | T2 | 245 | 52 | Drawing |
| T55BA | TS260 | — | 260 | 55 | General purpose - Aerosol tops |
| T57BA | TS275 | T3 | 275 | 57 | General purpose - Aerosols bodies |
| T50BA | TS290 | T4 | 290 | 59 | General purpose |
| T61CA | TH415 | T4 | 415 | 61 | Crown corks + Ends |
| T65CA | TH435 | T5 | 435 | 65 | Ends & Bodies - Aerosols bottoms |
| T70CA | — | T6 | 530 | 70 | (Non) easy open ends |
| DR520CA | TH526 | — | 520 | — | Ends |
| DR550BA | TS550 | DR8 | 550 | — | Bodies |
| DR550CA | TH550 | DR8 | 550 | — | Ends & Bodies |
| DR580CA | TH580 | — | 580 | — | Ends |
| DR620CA | TH620 | DR9 | 620 | — | Ends & DRD cans |
| DR660CA | — | DR9M | 660 | — | Ends |

After tinplating and the optional flow-melting the tinplate was subjected to the method steps according to the invention.

The inventors found that the tin-oxide species and oxide layer thickness found on the strip after anodic re-oxidation were remarkably consistent over the width of the strip. Earlier experiments performed in accordance with the prior art disclosed in EP2802688 revealed that there was a difference in oxide layer thickness and oxide species over the width. The prior art discloses that it is preferable that the oxide species is $SnO_2$. Due to the prior art process this oxide layer is deposited on top of the pre-existing layer, because there is no cathodic removal of the pre-existing oxide in the prior art. The inventors found that this cathodic removal is the key to obtaining a pure and bare tin surface, independent of the preceding treatment of the tinplate (flow-melting or not, extensive storage period or not, storage conditions favourable or not, etc.), and the subsequent deposition on this pure and bare surface of a new oxide layer which is homogeneous in thickness over the width of the tinplate strip, and consisting mainly of SnO rather than $SnO_2$. The inventors found that this surface formed the ideal tin-oxide surface for further processing towards packaging the application of the tinplate strip in the production of containers.

The tin oxide layer thickness is determined using a coulometric method. The tin oxide layer is reduced by a controlled small cathodic current in a 0.01M solution of hydrobromic acid (HBr) that is freed from oxygen by scrubbing with nitrogen. The progress of the reduction of the oxide is monitored by measuring the reduction potential, and the charge passed (A*t) for the complete reduction serves as a measure of the tin oxide layer thickness. For the test, a cylindrical cell is used having a circular aperture of ca. 4 cm diameter on one end and an Ag/AgCl reference electrode. The other end of the cell contains a platinum counter electrode. The test specimen covers the aperture, which is sealed using an O-ring to make a water-tight connection of a well-defined area, and is tightened into place using an air-pressure cylinder. The cell is connected to the electrolyte solution by a flexible tube so that it can be filled and emptied under nitrogen atmosphere. A cathodic current density of −0.50 A/m2 is applied to the sample using a potentiostat-galvanostat, and the potential is measured until the reduction is complete. A typical potential time curve is shown in FIG. 2. The inventors also found that these curves can be used to differentiate between tin-oxide species in the tin oxide layer (see FIG. 3).

By measuring and comparing samples taken over the width of the passivated tinplate strip the inventors found that the composition of the tin oxide in case of the tinplate with a tin oxide layer that predominantly consists of SnO is the same at the edges, whereas this is not the case for the samples where the tin oxide layer consists predominantly of $SnO_2$. The difference in potential at 25 s as measured at various locations over the width of a tinplate with a tin oxide layer that predominantly consists of SnO was less than 0.025 V at voltage levels of around −0.52 V, including the edges, whereas for tinplate with a presence of $SnO_2$ in the tin oxide layer the difference across the width is considerably higher and reaches values of −0.045 at voltage levels of −0.60 V.

Upon testing the adhesion and the sulphur staining resistance it was found that the specimens without $SnO_2$ has a better adhesion to organic coatings. Importantly, the specimens with a tin oxide layer that predominantly consists of SnO also show a better adhesion and sulphur staining resistance at the edges of the strip. So the resulting passivated tinplate shows not only a good adhesion and the sulphur staining resistance in the centre of the tinplate strip, but it does so at the edges as well.

Experimental results of the Q1=Q2 mode show that the dry adhesion of a critical white epoxy lacquer in a Gitterschnitt test performs well in both the centre and the edge (=5 cm from the edge of the strip). Values of 0 and 1 are deemed to be good results. Intermediate values between the edge and the centre give equivalent results.

TABLE 2

Classification of Gitterschnitt results

| m | edge | centre |
|---|---|---|
| 0 | 0 | 0/1 |
| 20 | 0 | 1 |
| 40 | 0 | 0/1 |
| 60 | 0/1 | 0/1 |
| 80 | 0 | 0/1 |
| 100 | 1 | 0 |

For this test, panels of 7.5×7.5 cm were cut from the flat sheet. A 4×5 mm cross-hatch is applied to the flat portion of the panel followed by adhesive tape according to the method as described in ISO 2409:1992, 2nd edition. After that delamination is evaluated using the Gitterschnitt scale ranging from 0 (excellent) to 5 (bad) (Table 3). All tests were performed in triplo for each side of each metal-laminate variant from Table 2. The score was then averaged over the three results. A value of 0/1 shows that 1 of the 3 samples resulted in a 1 and two in a 0 Gitterschnitt value.

TABLE 3

Classification of Gitterschnitt results

| Score | area affected | Description |
|---|---|---|
| 0 | 0% | The edges of the cuts are completely smooth; none of the squares of the lattice is detached |
| 1 | <5% | Detachment of small flakes of the coating at the intersections of the cuts. |
| 2 | <15% | The coating has flaked along the edges and/or at the intersections of the cuts. |
| 3 | <35% | The coating has flaked along the edges of the cuts party or wholly in large ribbons, and/or it has flaked party or wholly on different parts of the squares. |
| 4 | <65% | The coating has flaked along the edges of the cuts in large ribbons and/or some squares have detached party or wholly. |
| 5 | — | Any degree of flaking that cannot be classified by Rank 4 |

Sulphur staining tests using an epoxy gold standard lacquer after retorting at 130° C. for 1 h result in acceptable values with some outliers independent of the location in the strip (edge or centre).

BRIEF DESCRIPTION OF THE DRAWINGS

The invention will now be explained by means of the following, non-limiting figures.

FIG. 1 shows an embodiment of the invention to execute the method according to the invention. A tinning cell (I) is shown in which a strip (1) is led in the plating solution (2) as a cathode to be plated to produce tinplate. After tinning in one or more of such tinning cells the tinplate, and the optional flow-melting (not shown) is led into the electrochemical treatment tank (II) containing the basic aqueous solution (8). The tinplate enters the tank (II) via the non-conductive guide roller (3) in the entry pass (down-pass) as a cathode and passes past the anodes (6) for cathodically removing the pre-existing oxide and produce a bare and pure tin surface. After being redirected by the non-conductive counter-sink roll (4) the tinplate starts the exit pass (up-pass) and changes from cathode into an anode. During the exit pass the tinplate passes past the cathodes (7) for applying a fresh tin oxide layer onto the bare and pure tin surface. After exiting the bath past the non-conductive guide roller (5) the strip optionally enters a rinsing bath (III) and is dried (not shown). In section IV the tinplate strip a post-treatment agent (11) is applied to the tinplate strip by means of application means (10). The strip may subsequently be dried is necessary (not shown). The guide rollers 3 and 5 need to be non-conductive guide rollers. The term non-conductive in the general context of this invention means that the rollers do not conduct electricity.

Figure 2:
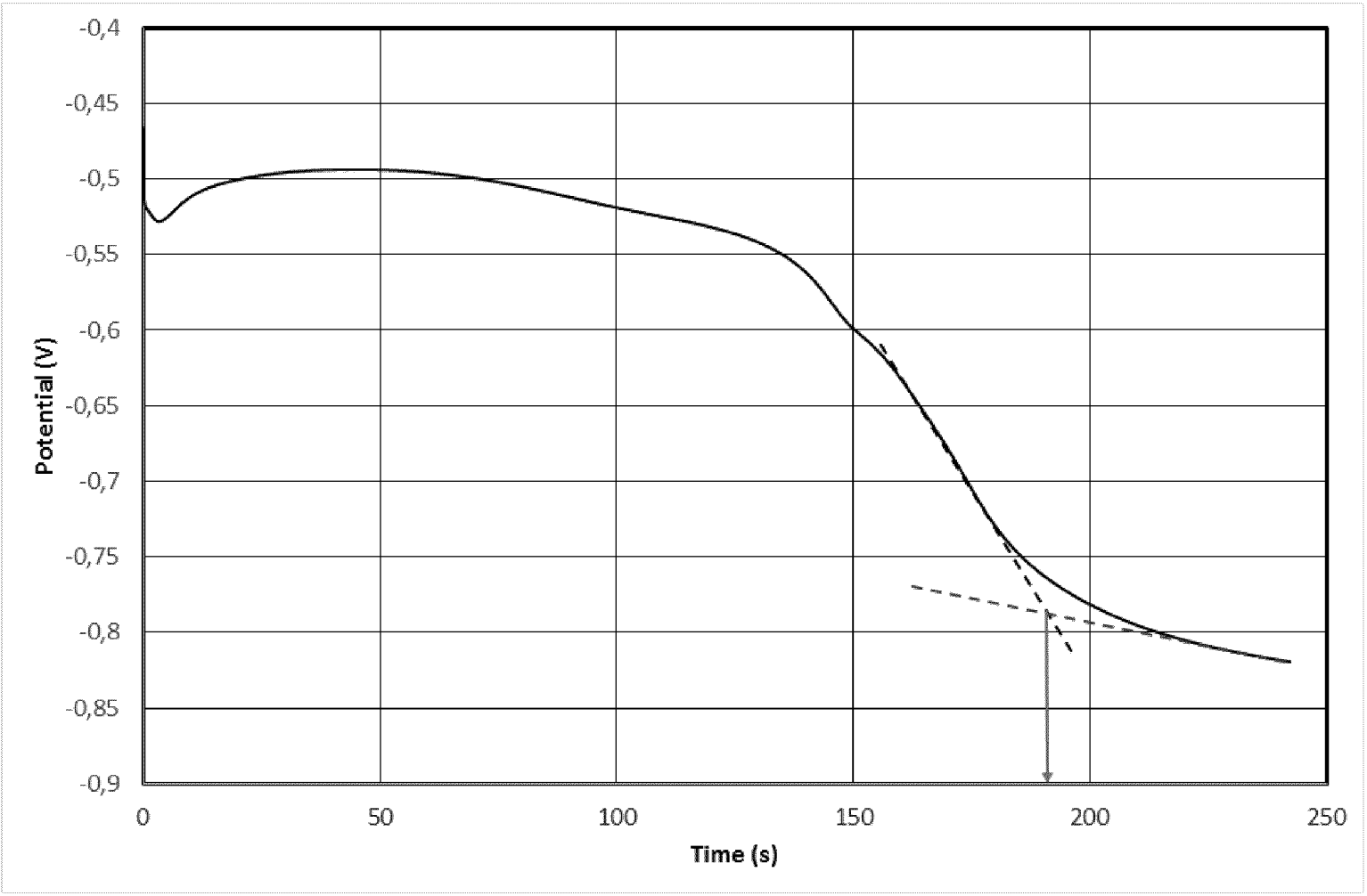
FIG. 2 shows a schematic drawing of the cathodic removal of the pre-existing tin-oxide layer.

A typical potential time curve is shown in FIG. 2, from which the tin oxide layer thickness is determined based on the time where the tangent of the curve at −0.7 V and the tangent of the curve around −0.85 V cross is taken as the basis for the calculation of the tin oxide layer thickness in $C/m^2$. In the example in FIG. 2 the time is about 190 s×0.50=95 $C/m^2$. The tin oxide layer thickness D, expressed in $C/m^2$, is obtained from D $[C/m^2]$=t [s]*0.50 $[A/m^2]$.

Figure 3:
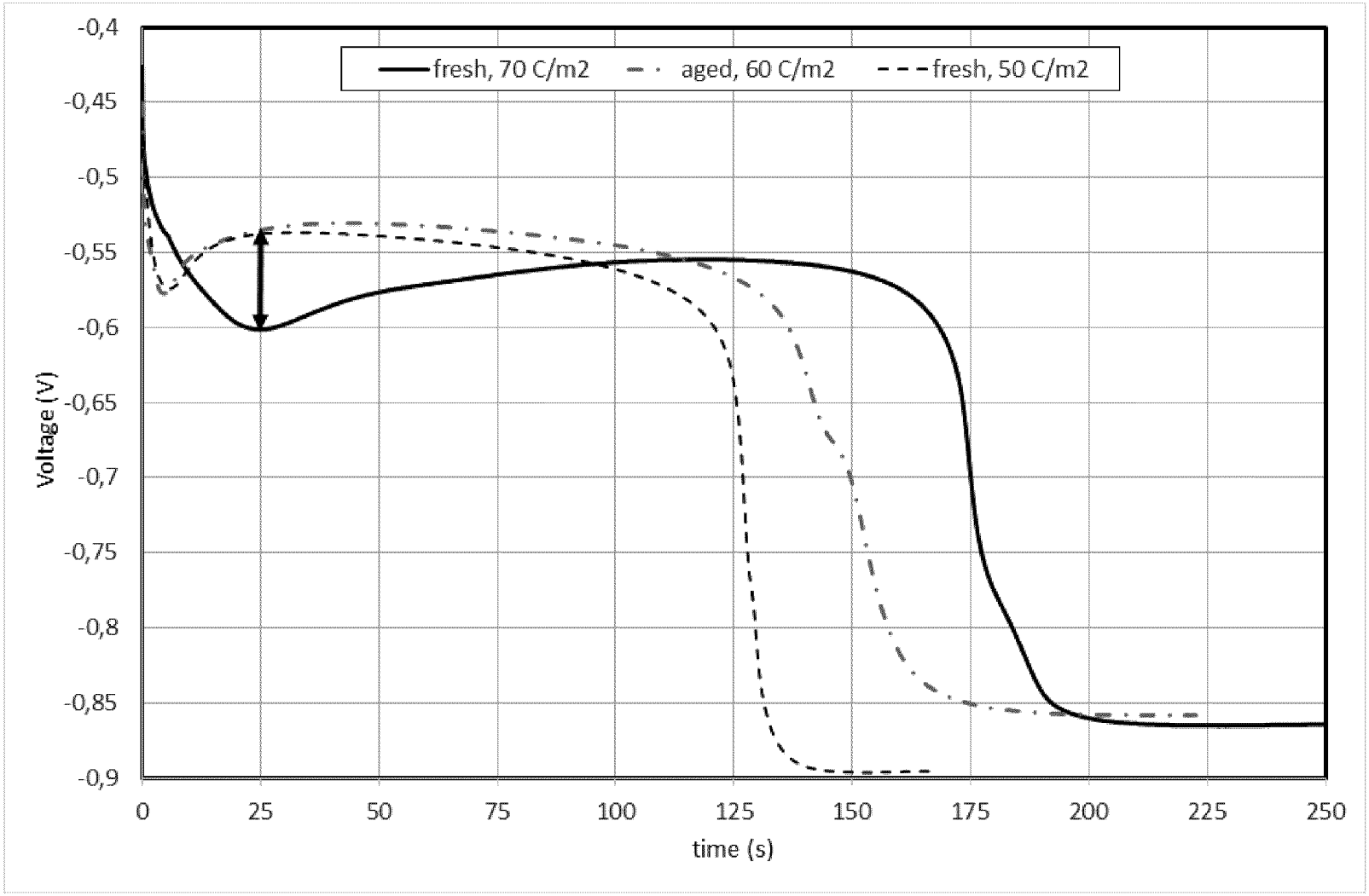
FIG. 3 shows the difference between the V-t response of the cathodic removal of a pre-existing tin-oxide layer based on $SnO_2$ and of a pre-existing tin-oxide layer based on SnO.

In FIG. 3 there is a distinct difference observable at t=25 between the curve with thick layer compared to the thinner layer, both produced on a fresh tin surface (i.e. the pre-existing oxide is cathodically and fully removed). The dip at t=25 s is consistent for thicker layers and is associated with the presence of $SnO_2$ in the tin oxide layer. The other two curves have a shape that is consistent with a tin oxide layer that predominantly consists of SnO.

Figure 1:
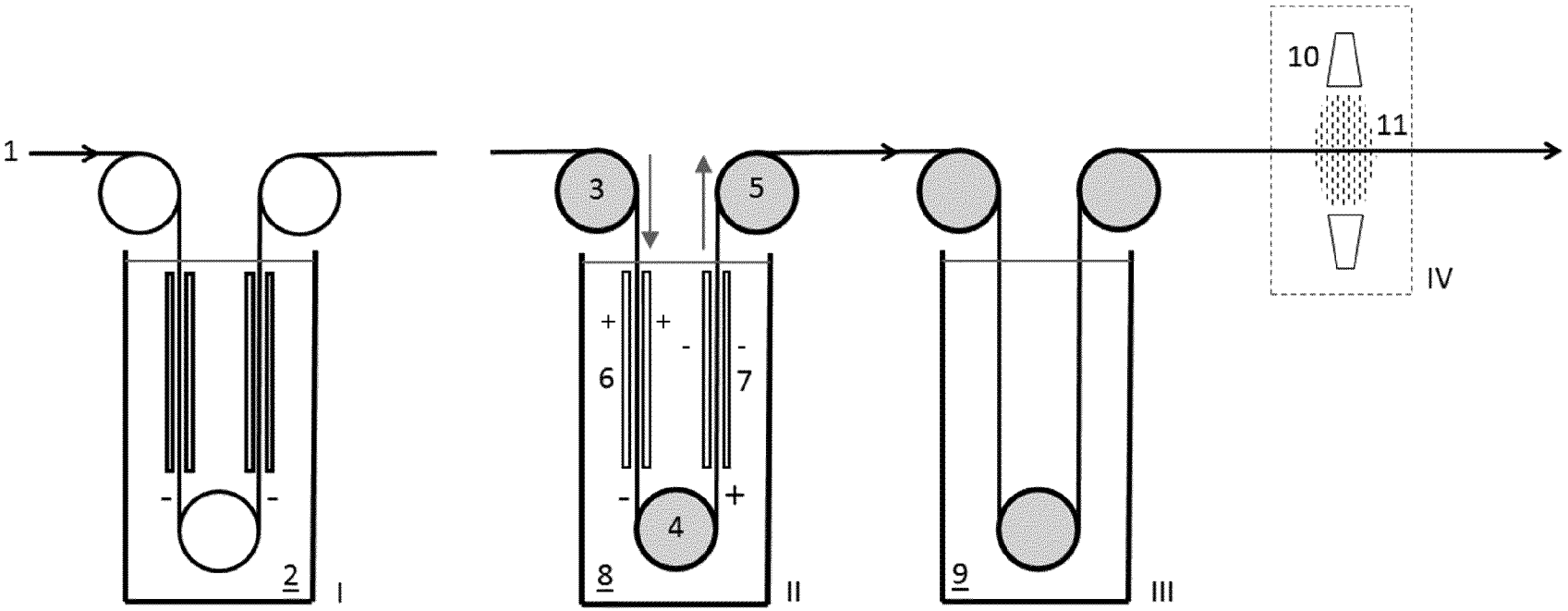
FIG. 1 shows a schematic drawing of an apparatus for the method according to the invention.
Figure 4:
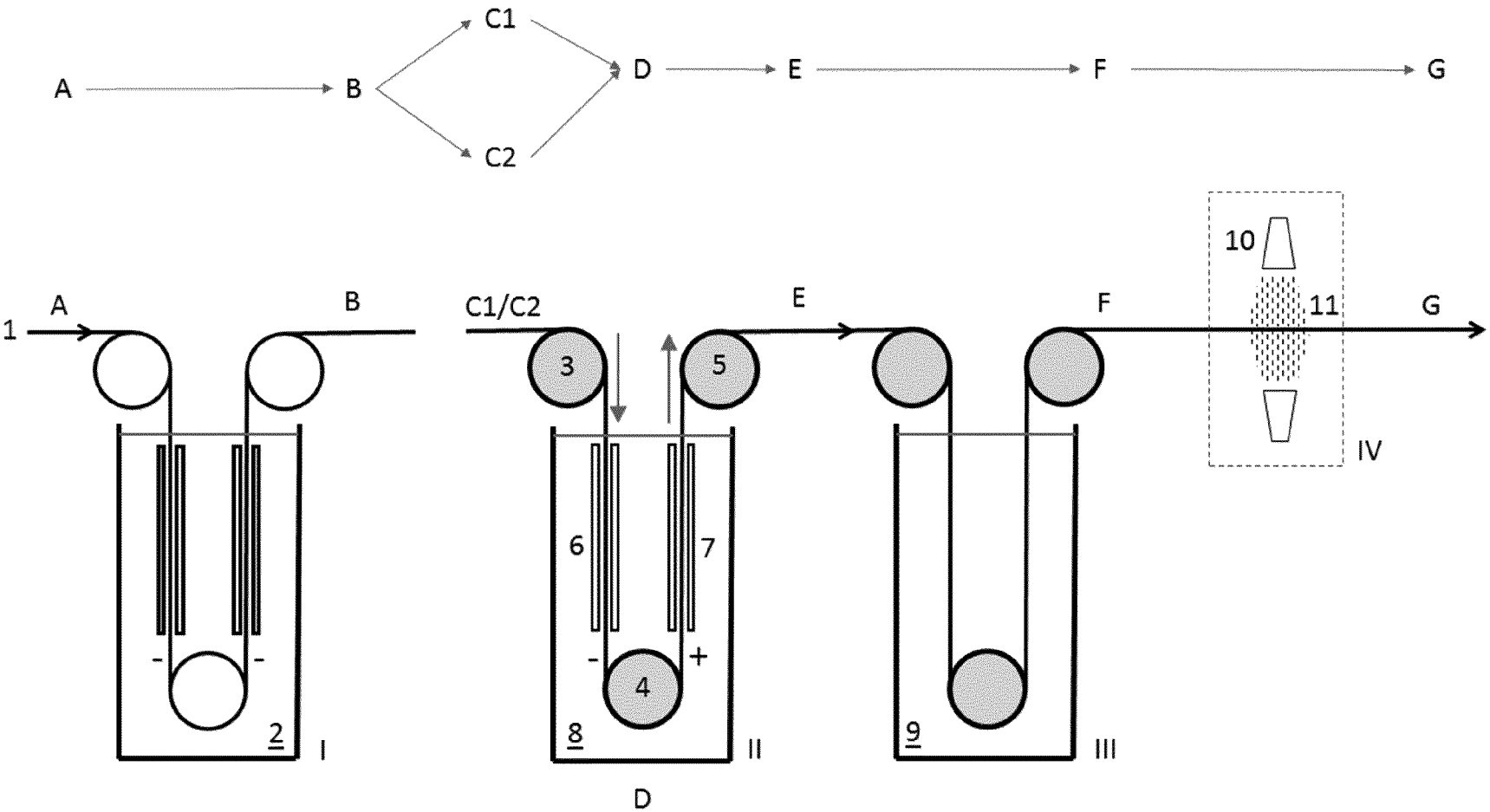
FIG. 4 shows a schematic representation of the various stages during the process according to the invention on the basis of a blackplate strip as feed stock.

In FIG. 4 the set-up of FIG. 1 is reproduced, and the letters A to G represent various stages of the development of the layers on the blackplate.

Figure 5:
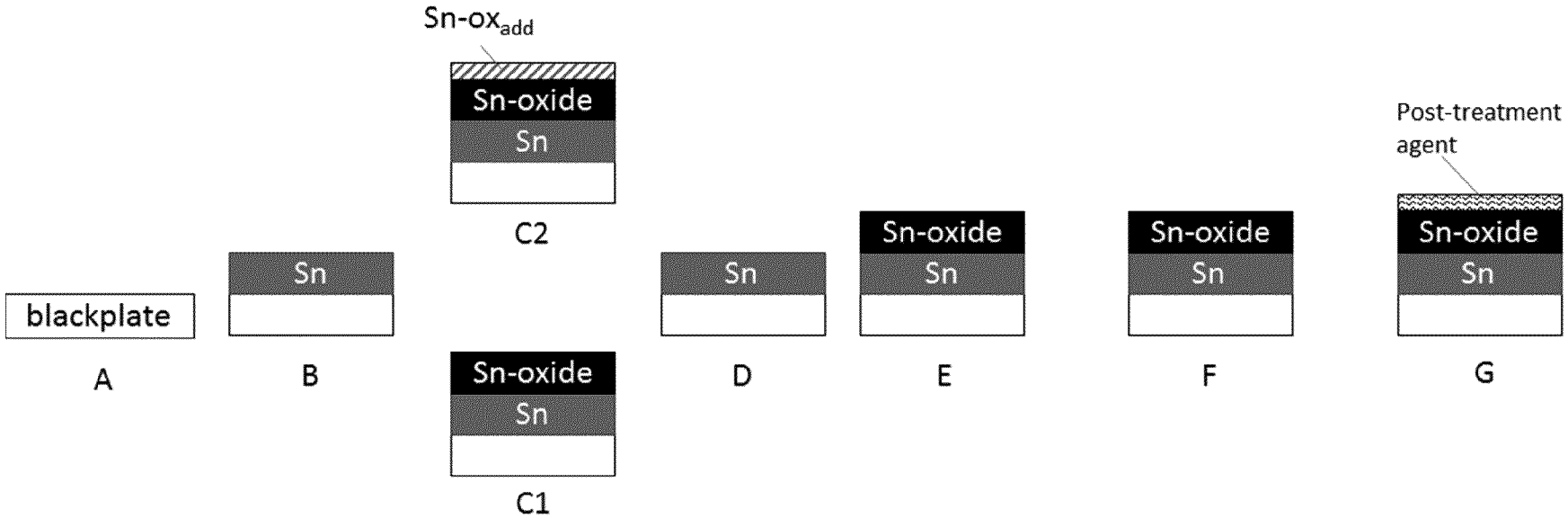
FIG. 5 shows a schematic representation of the various build-ups of the layers as presented in FIG. 4. The thickness of the blackplate and the thicknesses of the various layers shown are not to scale.

In FIG. 5 the letters represent the following:

A: Blackplate strip feed-stock;

B: Tinplate (i.e. blackplate coated with a tin layer in tin plating cell I);

C1: Tinplate with a pre-existing oxide and uninterrupted processing (no additional oxide growth);

C2: Tinplate with a pre-existing oxide and an additional oxide layer due to extended storage and/or storage under conditions leading to additional oxide layer growth;

D: Pure and bare tin layer on blackplate after removal of the pre-existing oxide layer;

E: Anodically re-oxidised tinplate;

F: Cleaned and rinsed anodically re-oxidised tinplate;

G: Anodically re-oxidised tinplate provided with post-treatment agent.

The invention claimed is:

1. A method for passivating a tinplate strip in a continuous process, comprising:

after electrodepositing a tin layer or layers on a steel strip to make the tinplate strip or after an optional flow-melting of the electrodeposited tin layer or layers, passing the tinplate strip into a basic aqueous solution in an electrochemical treatment tank and then moving the tinplate strip in an entry-pass comprising moving the tinplate strip between anodes within the basic aqueous solution in the electrochemical treatment tank, and after the entry pass moving the tinplate strip in an exit pass comprising moving the tinplate strip between cathodes within the basic aqueous solution in the electrochemical treatment tank, and after the exit pass discharging the tinplate strip from the basic aqueous solution and the electrochemical treatment tank, wherein the tinplate strip moves from the entry pass to the exit pass without leaving the basic aqueous solution in the electrochemical treatment tank, wherein any pre-existing tin-oxide layer on the tinplate surface is cathodically removed from the tinplate surface during the entry-pass to produce a bare tin surface, and wherein the bare tin surface is subsequently immediately anodically re-oxidised during the exit pass to form a new tin-oxide layer, wherein the charge for cathodically removing the pre-existing tin-oxide layer from the tinplate surface is Q1, and wherein the charge for anodically re-oxidising the tinplate is Q2 and wherein Q1<Q2, wherein the imposed charge density for the anodic re-oxidation and the cathodic removal of the pre-existing tin-oxide layer is identical and equal to Q2 and is at least 15 $C/m^2$ and wherein the anodically re-oxidised tinplate is rinsed and dried after exiting the basic aqueous solution.

2. The method according to claim 1, wherein the imposed charge density for the anodic re-oxidation is at most 100 C/m2.

3. The method according to claim 1, wherein the anodically re-oxidised tinplate is covered with an oxide layer having a thickness D expressed in $C/m^2$ and representing the total charge needed to reduce the oxide layer to metallic tin, which is related to the re-oxidation time t and the current density A by D=E×A×t, where E is the efficiency of the electrochemical reaction, and wherein D is between 15 and 100 $C/m^2$.

4. The method according to claim 1, wherein a liquid solution of a chromium-free post-treatment agent is applied to the rinsed and dried anodically oxidised tinplate surface to produce a post-treated tinplate, wherein the chromium-free post-treatment agent is selected from copolymers of acrylates, polymethyl siloxanes with polyether side chains, acid polyethers, polymers with heterocyclic groups and acid, aqueous, liquid compounds which contain complex metal fluoride anions with divalent to tetravalent cations and polymeric substances.

5. The method according to claim 3, wherein the current density A during anodic oxidation is at least 10 $A/m^2$.

6. The method according to claim 3, wherein the current density A during anodic oxidation is at most 4000 $A/m^2$.

7. The method according to claim 1, wherein the basic aqueous solution is chosen from an alkali metal or alkaline earth metal hydroxide or carbonate, a basic alkali metal phosphate, and a basic organic alkali metal or alkaline earth metal salt.

8. The method according to claim 1, wherein the basic aqueous solution has a pH of between 8.75 and 10.5.

9. The method according to claim 1, wherein wherein the anodic re-oxidation time t is at between 0.05 seconds and 1.5 seconds.

10. The method according to claim 1, wherein the tinplate is led into the basic aqueous solution immediately after the electrodepositing of the tin layer or layers on the steel strip, or immediately after the flow-melting of the electrodeposited tin layer or layers.

11. The method according to claim 1, wherein the tin-oxide layer after anodic re-oxidation consists mainly of SnO.

12. The method according to claim 1, wherein a thermoplastic polymer coating is applied directly on the rinsed and dried anodically re-oxidised tinplate, wherein the tin-oxide layer after anodic re-oxidation consists mainly of SnO.

13. The method according to claim 4, wherein a thermoplastic polymer coating is applied directly on the post-treated tinplate, wherein the tin-oxide layer after anodic re-oxidation consists mainly of SnO.

14. The method according to claim 1, wherein the tin-oxide layer after anodic re-oxidation consists mainly of SnO and wherein the tin-oxide layer after rinsing and drying is subjected to a subsequent treatment with a no-rinse/dry-in-place post-treatment agent based on titanium or a combination of titanium and zirconium which is prepared as a solution with a dry coverage in the range of 0.2 to 2 mg $Ti/m^2$.

15. The method according to claim 1, comprising wherein the electrodepositing of the tin layer or layers is performed on an electrolytic tinning line, optionally melting the tin layer;

wherein the aqueous basis solution is held within an electrochemical treatment tank for holding;

wherein a non-conductive guide roller guides the cathodic tinplate into the electrochemical treatment tank past the anodes during the entry-pass;

wherein a non-conductive sink roll directs the tinplate from the entry-pass to the exit-pass guiding the anodic tinplate past the cathodes during the exit-pass;

wherein potential is applied between the tinplate strip and the counter electrodes for the cathodic removal of the pre-existing oxide layer and the anodic re-oxidation of the tinplate strip, wherein a non-conductive guide roller guides the tinplate from the electrochemical treatment tank to means for rinsing and drying the tinplate, and optionally applying a liquid solution of a chromium-free post-treatment agent.

16. The method according to claim 4, wherein the chromium-free post-treatment agent comprises fluoro-titanates and zirconium-titanates.

17. The method according to claim 5, wherein the current density A during anodic oxidation is at least 50 $A/m^2$.

18. The method according to claim 5, wherein the current density A during anodic oxidation is at least 100 $A/m^2$, and wherein the current density A during anodic oxidation is at most 2000 $A/m^2$.

19. The method according to claim 7, wherein the basic aqueous solution contains sodium carbonate.

20. The method according to claim 1, wherein moving the tinplate strip in the direction between the anodes within the basic aqueous solution in the electrochemical treatment tank in the entry-pass comprises moving the tinplate strip in a downward direction between the anodes, and wherein moving the tinplate strip in the direction between the cathodes within the basic aqueous solution in the electrochemical treatment tank in the exit pass comprising moving the tinplate strip in an upward direction between the cathodes.

* * * * *